US007237733B2

(12) United States Patent
Vikman

(10) Patent No.: US 7,237,733 B2
(45) Date of Patent: Jul. 3, 2007

(54) METHOD AND APPARATUS FOR PRODUCING MECHANICAL FIBERS

(75) Inventor: Kai Vikman, Kirkniemi (FI)

(73) Assignee: M-real Oyj, Espoo (FI)

( * ) Notice: Subject to any disclaimer, the term of this patent is extended or adjusted under 35 U.S.C. 154(b) by 99 days.

(21) Appl. No.: 10/535,186

(22) PCT Filed: Nov. 18, 2003

(86) PCT No.: PCT/FI03/00880

§ 371 (c)(1),
(2), (4) Date: May 17, 2005

(87) PCT Pub. No.: WO2004/046455

PCT Pub. Date: Jun. 3, 2004

(65) Prior Publication Data

US 2005/0284970 A1 Dec. 29, 2005

(30) Foreign Application Priority Data

Nov. 18, 2002 (FI) ..... 20022050

(51) Int. Cl.
*B02C 1/00* (2006.01)
*B02C 11/08* (2006.01)

(52) U.S. Cl. ..... 241/21; 241/23

(58) Field of Classification Search ..... 241/21, 241/23, 28, 152.1, 157, 161, 162, 163, 48, 241/57; 162/23, 28, 29
See application file for complete search history.

(56) References Cited

U.S. PATENT DOCUMENTS

| | | | | |
|---|---|---|---|---|
| 4,136,831 | A * | 1/1979 | Cederquist et al. | 241/18 |
| 4,235,665 | A * | 11/1980 | Reinhall et al. | 162/23 |
| 4,421,595 | A * | 12/1983 | Huusari | 162/23 |
| 4,537,655 | A * | 8/1985 | Henriksson et al. | 162/23 |
| 4,606,789 | A * | 8/1986 | Reinhall | 162/23 |
| 5,016,824 | A * | 5/1991 | Pietinen et al. | 241/21 |
| 5,145,010 | A * | 9/1992 | Danielsson et al. | 162/26 |
| 6,364,998 | B1 | 4/2002 | Sabourin | 162/23 |

FOREIGN PATENT DOCUMENTS

| | | |
|---|---|---|
| CA | 1 125 077 A | 6/1982 |
| FI | 70435 B | 3/1986 |
| SE | 7810876-8 B | 3/1982 |
| WO | 96/18769 A1 | 6/1996 |

* cited by examiner

*Primary Examiner*—Faye Francis
(74) *Attorney, Agent, or Firm*—Kubovcik & Kubovcik

(57) ABSTRACT

The purpose of this invention is to provide a method and an apparatus for producing thermomechanical fibers using less energy per ton that has previously been required for similar type of production. The invention is based in that at least two refiners are combined so that mixture of chips, water and steam is first fed into a first refiner wherein the chips are broken up and the mass flow from the first refiner is then fed into the second refiner for breaking the fibers to final freeness level. The mass flow of steam and fibers is fed forwards at least in the first refiner by the rotational energy of the refiner rotor so that essentially no flowback of the steam occurs. The mass flow exciting the first refiner is fed completely to the second refiner and no steam is extracted from the mass flow before the second refiner.

7 Claims, 1 Drawing Sheet

METHOD AND APPARATUS FOR PRODUCING MECHANICAL FIBERS

This application is a 371 of international application PCT/FI2003/000880, which claims priority based on Finnish patent application No. 20022050 filed Nov. 18, 2002, which is incorporated herein by reference.

FIELD OF THE INVENTION

The invention relates to producing thermomechanical fibers by a refining process using at least one refiner.

Invention also relates to an apparatus for implementing the method.

BACKGROUND OF THE INVENTION

In the refining process, wood is fed in chip form into a narrow gap between stator and rotor of a refiner together with water. The cross section of the gap narrows from the center of the refiner towards the outer perimeter. The surfaces of the rotor and stator have bars that have edges for breaking the wood material into fibers. The chips are defibrated and fibrillated during their passage through the refiner. Refining can take place in one refiner or it can be continued in subsequent refiners.

The chips are fed into the center of a refiner and strike first the edges of a breaker bar and the chips are broken into pieces. Refining of these pieces begins when the pieces strike each other as well as the refiner rotor and stator edges. Centrifugal force drives this coarse wood and fiber mixture outward in radial direction the disc gap stator and rotor plates and the gap becomes smaller. The interaction between rotor, stator and fiber defibrates and fibrillates the fiber material to the final freeness level. The collisions between fiber and rotor bar edges and collisions between fibers, friction between fiber and segment surfaces and internal friction in the fiber phase consume a considerable amount of energy. This energy is transformed into heat, which increases the temperature of the water and fiber and thus evaporates the water into steam. This steam has strong influence on fiber flow in the disc gap. Depending on the pressure conditions before and after the refiner, some of the steam flows toward the chip feed as a flowback steam and some flows forward with the fiber flow. The steam flow is restricted due to narrow disc gap and, because of this, the pressure and the temperature in the disc gap can be noticeably higher than those in the refiner housing or feed. The heat in the refining process changes the rheological properties of wood and fiber and has an important influence on the final fiber quality.

Very often two serial refiners are used in a refining process. In such a process once refined raw fibers exit from the first refiner together with steam and exhaust velocity of the steam and chips is used for transporting the fibers to the second refiner. Since large amount of steam is generated in the first refiner, excess steam has to be removed from the flow before feeding the chips to the second refiner. Therefore, the outflow of the first refiner is led to a cyclone wherein excess steam is separated. The separated steam can be fed into the first refining stage. From the cyclone the defibrated fibers are fed into the second refiner, wherein it is further refined to final freeness. After the second refiner the mixture of fibres and steam is fed into a second cyclone for separating steam and fibers.

This kind of process requires large amount of energy for each ton of fibers produced. One factor that increases the amount of energy needed, is the generation of steam in the refiners. Steam is needed for transporting the refined fibers within the refiner between the stator and rotor or rotor to rotor especially from first refiner to the second refiner. In present processes large amount of steam is needed for transporting the fibers. This extra steam has to be removed from the fiber flow before it is fed into the second refiner. Steam or water is also needed for cooling the fibers that is heated due to friction between the refiner plates. If the consistency of the fibers is not right, the dwell time of the mass in the refiner may become longer and the mass may overheat and become dark. Longer residense times also change the refining result and quality of the fibers.

In conventional process steam is separated from fibers in between the refining stages. This steam is typically used in paper machine and therefore it requires very high pressure to first stage refiners housing and second stage refiners feed.

OBJECT OF THE INVENTION

The purpose of this invention is to provide a method and an apparatus for producing thermomechanical fibers using less energy per ton that has previously been required for similar type of production.

SUMMARY OF THE INVENTION

The invention is based in that at least two refiners are combined so that mixture of chips, water and steam is first fed into a first refiner wherein the chips are broken up and the mass flow from the first refiner is then fed into the second refiner for breaking the fibers to final freeness level. The mass flow of steam and fibers is fed forwards at least in the first refiner by the rotational energy of the refiner rotor so that essentially no flowback of the steam occurs. The mass flow exciting the first refiner is fed completely to the second refiner and no steam is extracted from the mass flow before the second refiner.

More specifically, the refining method according to the invention is characterized by feeding the flow of mixture of a material that is groundfibers that are refined and steam forward at least in the first refining (3) stage by rotary energy of a rotor of the refiner so that no essential back-flow of the steam occurs, transferring the mass flowfiber and steam mixture exciting the first refiner totally into the second refiner without separating steam from the flow, and feeding the mixture through a flow path having a cross section that is constant or decreasing between at least the exit of the first refining (3) stage and infeed of the second refining stage.

The apparatus for implementing the method is characterized in that the cross section of the flow path between at least the exit of the first refining (3) stage and infeed of the second refining stage is constant or preferably decreasing.

ADVANTAGES OF THE INVENTION

The invention offers significant benefits.

The greatest benefit of the invention is decrease in amount of energy required for producing the fibers. Further, the properties of the produced fiber like color and fiber length may change or can be changed by effecting the process conditions according to the invention. Whether this leads to improvement of fiber quality depends on which properties are desired for making the final paper product. Since different kind of products require different properties from the fiber, the fibers made by the invention is better suitable for some products that others and improvement of quality is thus paper grade specific. However, the invention provides enhanced possibilities for controlling the residence time of the fibers and other process parameters whereby the fibers can be made more accurately to specific requirements and the quality is thus increased.

The average residence time of the fibers in the refiners is shorter than in known systems and peak temperatures are also lowered. Temperature level variations are also smaller. Because of this, danger for darkening of the fibers is smaller and it is possible to produce brighter fibers. The pressure from the previous stage housing to the following stage can be freely chosen to improve the fiber properties. Lower operating pressure reduces stresses of the machinery whereby bearings, frame and other parts of the apparatus can de designed for lower loads. Infeed of water or steam is not needed for regulating the temperature in the refiner and no steam is produced in the refiner.

DETAILED DESCRIPTION OF THE INVENTION

Figure 1:
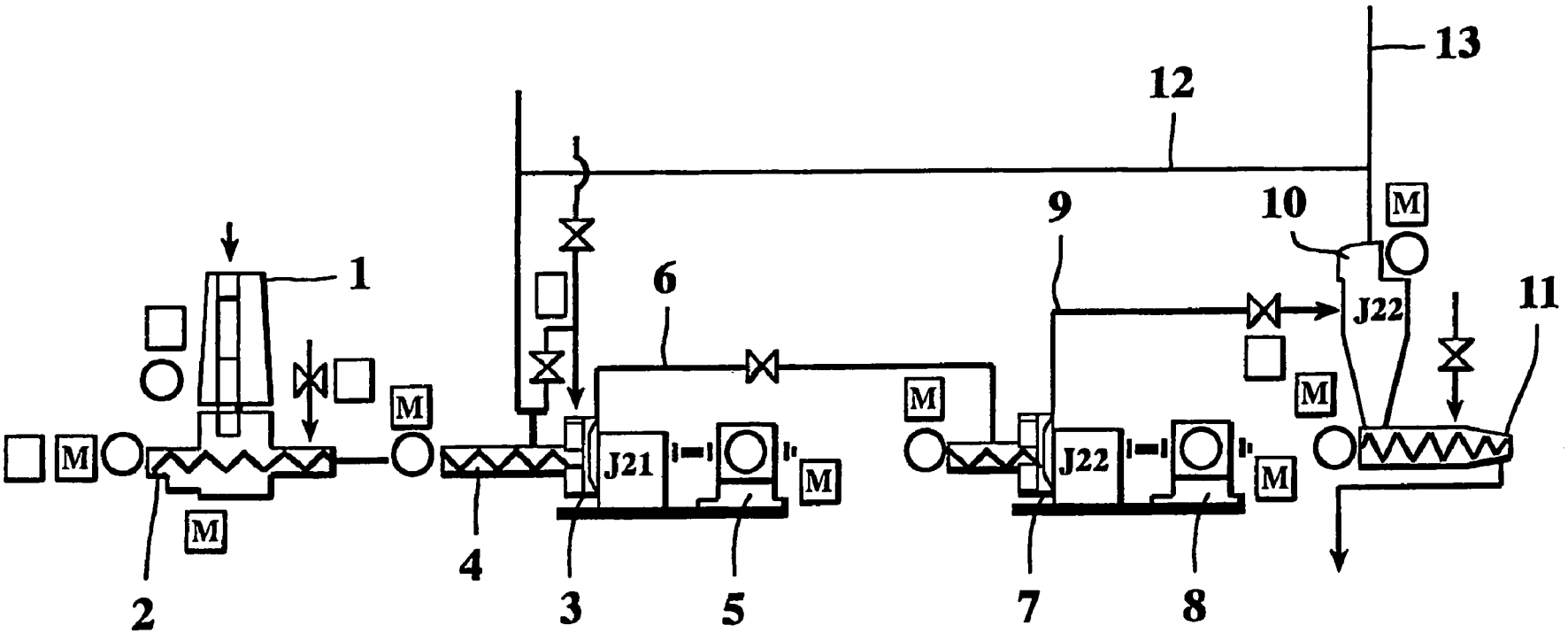
FIG. 1 shows main parts of a fiber producing line. The first apparatus in the line is a silo 1, into which prefabricated wood chips are fed.

Objects and features of the invention will become apparent from the following detailed description considered in conjunction with the accompanying drawing. It is to be understood, however, that the drawings are intended solely for purposes of illustration and not as a definition of the limits of the invention, for which reference should be made to the appended claims.

The drawing shows main parts of a fiber producing line. The first apparatus in the line is a silo 1, into which prefabricated wood chips are fed. At the bottom of the silo 1 is a feeding screw 2 for removing the chips from the silo 1 feeding them further in the line. Next in line is a first refiner 3 into which chips are fed by a second feeding screw 4. The refiner 3 is driven by an electric motor 5 that rotates the rotor of the refiner. The rotor works against a stationery stator and chips that are refined travel in the gap of the stator and the rotor. The rotary force of the rotor pushes the mixture of chips and steam forward in the gap and not overpressure over the gap is used for feeding the chips. For this reason no extra steam is required and the consistency of the mixture can be kept optimum.

From the first refiner 3 the mixture of steam and once refined fibers is fed by the force of the rotor to the infeed line 6 of the second refiner 7. The second refiner is driven by an electric motor 8. The total mass volume exciting the first refiner 3 enters the second refiner 7, wherein the fibers are refined into the final, desired freeness. Like in the first refiner, the rotary force of rotor of the refiner forces the fiber/steam mixture to travel towards the perimeter to the refiner, wherein the mixture exits exit line 9. All of the mass volume exciting the first refiner 3 is transferred into the second refiner. This can be done since the fiber mass is transferred by the rotary force of the refiner only and no extra steam is required in the refiners for creating a pressure difference over the refiner for transferring the fibers. Thus, no separation of steam is required between refiners and the consistency of the fiber/steam mixture exciting the first refiner is suitable for feeding into the second refiner. Finally, the mass flow exciting the second refiner is fed into a cyclone 10 where steam is separated from the fibers and fibers are transported further by a feed screw 11. The steam separated from the fibers can be returned to the first refiner 3 through return line 12 or lead to some other use through line 13.

One important feature of the invention is that the cross section of the path of the fiber/steam mixture beginning from the exit of the first refiner end ending to the infeed of the second refiner and finally to the gap of the staor and the rotor of the second refined does not enlarge over the length of the path. If it is necessary to accelerate the speed of the mixture the cross section of the path can be made decreasing. The pressure over the infeed line 6 of the second refiner 7 is constant and all possibly needed acceleration can be provided by decreasing the cross section of the infeed channel. The speed of the mass flow should not decrease in the infeed line of the refiners. This concerns average residence time of the fibers or average speed of the mass flow since for small parts of the flow the speed or residence time may vary largely in different parts of the process. No feeders are needed between the refiners.

Another characterizing feature is that essentially no steam is produced in the refiners. All steam need for forming a carrying medium for fibers is fed into the first refiner and very small amount of water can be added to the refiners so that major part of the steam that is formed is evaporated from the moisture of the chips. For this reason only small amount of energy of the refiners is transferred to heat for forming steam. Since essentially no extra steam is formed in the first refiner there is no need for a cyclone between the refiners for separation of the steam. Since there is no cyclone between the refiner stages, the residence time of the fibers is 50% of the residence time of processes using cyclone. It is evident that if no water is added in the process in order to control the energy balances of the refiners, for example for cooling the process, the energy balance of the process must be controlled in some other way. According to the invention this is accomplished by using the pumping action of the refining rotors for transporting the mass flow in the process. Since the rotary energy of the refiners is directed for working on the fibers and for transporting the steam/fiber mixture, there is no need to cool the refiners by feeding large amounts of water in the process. Since small pressure difference over refiners is only needed for feeding the fibers, there is no need to produce steam for other purposes either. The pressure from the previous stage housing to the following stage can be freely chosen to improve the fiber properties. The indication that process operates properly is that no or very little steam flows back in the refiners.

The example above describes a method wherein two refining stages are used. It is clear that number of the refining stages may be greater if so desired. The two succeeding refiner stages according to the invention may then be located in any place in the process. The invention may also be accomplished by a single two-staged refiner wherein the refining stages are arranged to work according to the invention. There are three main types of high consistency refiners: single disc, double disc and conical disc. In a typical refiner by Metso Paper a flat refining zone is followed by conical refining zone.

Thus, while there have been shown and described and pointed out fundamental novel features of the invention as applied to a preferred embodiment thereof, it will be understood that various omissions and substitutions and changes in the form and details of the invention may be made by those skilled in the art without departing from the spirit of the invention. For example, it is expressly intended that all combinations of those elements and/or method steps, which substantially perform the same results, are within the scope of the invention. Substitutions of the elements from one described embodiment to another are also fully intended and contemplated. It is also to be understood that the drawings are not necessarily drawn to scale but they are merely conceptual in nature. It is the intention, therefor, to be limited only as indicated by the scope of the claims appended hereto.

The invention claimed is:

1. Method for producing thermomechanical fibers from wood chips comprising at least the steps of providing least two refining stages, each refining stage including a rotor and a stator, feeding at least wood chips and steam into the first refining stage, defibrating the wood chips to fibers in the first refining stage to obtain a flow of steam and once refined fibers, removing the flow of steam and once refined fibers from the first refining stage, feeding the flow of refined fibers and steam into the second refining stage, refining the once refined fibers in the second refining stage to produce a flow of twice refined fibers and steam, and removing the flow of twice refined fibers and steam from the second refining stage;

said method being characterized by feeding the flow of once refined fibers and steam forward in the first refining stage by rotary energy of the rotor of the refining stage so that no essential back-flow of the steam occurs, transferring the total flow of the once refined fibers and steam exiting the first refining stage into the second refining stage without separating steam from the flow, and feeding the flow of once refined fibers and steam through a flow path having a cross section that is constant or decreasing between at least the exit of the first refining stage and infeed of the second refining stage.

2. Method according to the claim 1, characterized in that the steam fed into the first refining stage and formed therein forms the transport medium of the mass that is refined.

3. Method according to claim 1 characterized in that a residence time of the fibers in the process is less than 50% of a residence time required in processes using a cyclone between refiner stages.

4. Method according to claim 1, further comprising separating steam from the twice refined fibers after the second refining stage and feeding at least part of that steam back to the first refining stage.

5. Method according to claim 1, further comprising separating steam from the twice refined fibers after the second refining stage and feeding that steam back to the first refining stage.

6. Method according to claim 1, further comprising keeping the medium velocity of the flow of once refined fibers and steam constant or preferably accelerating said flow between at least the exit of the first refining stage and infeed of the second refining stage.

7. Method according to claim 1, characterized in that steam is separated only once from the process.

* * * * *